US009559451B2

(12) United States Patent
Uchida et al.

(10) Patent No.: US 9,559,451 B2
(45) Date of Patent: Jan. 31, 2017

(54) PRESS-FIT TERMINAL, CONNECTOR AND PRESS-FIT TERMINAL CONTINUOUS BODY EMPLOYING SAME, AND WOUND PRESS-FIT TERMINAL CONTINUOUS BODY

(71) Applicant: J.S.T. Mfg. Co., Ltd., Osaka-shi (JP)

(72) Inventors: Yoshihide Uchida, Tsuyama (JP); Takeshi Hinakawa, Tsuyama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/365,229

(22) PCT Filed: Dec. 13, 2012

(86) PCT No.: PCT/JP2012/082388

§ 371 (c)(1),
(2) Date: Jun. 13, 2014

(87) PCT Pub. No.: WO2013/094520

PCT Pub. Date: Jun. 27, 2013

(65) Prior Publication Data

US 2014/0342619 A1 Nov. 20, 2014

(30) Foreign Application Priority Data

Dec. 22, 2011 (JP) ..... 2011-281531

(51) Int. Cl.
*H01R 13/41* (2006.01)
*H01R 12/58* (2011.01)
(Continued)

(52) U.S. Cl.
CPC ..... *H01R 13/41* (2013.01); *H01R 12/585* (2013.01); *H01R 12/724* (2013.01); *H01R 43/16* (2013.01); *H01R 43/205* (2013.01)

(58) Field of Classification Search
CPC ..... H01R 12/585; H01R 13/41; H01R 43/16
(Continued)

(56) References Cited

U.S. PATENT DOCUMENTS 4,188,715 A * 2/1980 Ammon et al. ..... 29/884
4,740,166 A * 4/1988 Barnhouse ..... 439/751
(Continued)

FOREIGN PATENT DOCUMENTS

CA 1304801 7/1992
CN 2391324 Y 8/2000
(Continued)

OTHER PUBLICATIONS

International Search Report for International Application No. PCT/JP2012/082388 dated Feb. 26, 2013.
(Continued)

*Primary Examiner* — Briggitte R Hammond
(74) *Attorney, Agent, or Firm* — Kratz, Quintos & Hanson, LLP

(57) ABSTRACT

A press-fit terminal is made up of a wire material of predetermined length. At a first end of wire material of the press-fit terminal is formed a tip for insertion into a substrate, and at the other end is formed a connection portion for connection to a corresponding terminal. A press-fit portion for press-fitting into the substrate is formed at the tip side of the wire material of the press-fit terminal, and a shoulder portion is formed to the connecting portion side of the press-fit portion. By making use of the press-fit terminal, damage to the substrate and breakage of contacts can be minimized, consistent insertion force and retaining force can be attained.

15 Claims, 11 Drawing Sheets

(51) Int. Cl.

| | |
|---|---|
| ***H01R 12/72*** | (2011.01) |
| *H01R 43/16* | (2006.01) |
| *H01R 43/20* | (2006.01) |

(58) Field of Classification Search
USPC ..... 439/82, 733.1, 751
See application file for complete search history.

(56) References Cited

U.S. PATENT DOCUMENTS

| | | | | |
|---|---|---|---|---|
| 4,828,514 | A | 5/1989 | Johnson | |
| 5,893,779 | A * | 4/1999 | Bianca et al. | 439/751 |
| 5,944,563 | A | 8/1999 | Nagafuji | |
| 5,980,271 | A | 11/1999 | MacDougall et al. | |
| 6,042,429 | A | 3/2000 | Bianca et al. | |
| 6,406,338 | B1 | 6/2002 | Endo et al. | |
| 6,442,834 | B1 | 9/2002 | Takahashi | |
| 6,719,573 | B2 * | 4/2004 | Koehler et al. | 439/751 |
| 7,048,595 | B2 * | 5/2006 | Nakamura et al. | 439/751 |
| 7,083,478 | B1 * | 8/2006 | Kutsuna | H01R 13/41 439/733.1 |
| 2003/0049972 | A1 * | 3/2003 | Aoki | 439/751 |
| 2005/0112959 | A1 * | 5/2005 | Lai | H01R 13/2435 439/862 |
| 2006/0246786 | A1 | 11/2006 | Noguchi | |
| 2007/0293100 | A1 | 12/2007 | Jakob et al. | |

FOREIGN PATENT DOCUMENTS

| | | | |
|---|---|---|---|
| CN | 2519453 | Y | 10/2002 |
| CN | 101218713 | A | 7/2008 |
| EP | 0 325 296 | A2 | 7/1989 |
| EP | 1069651 | A1 | 1/2001 |
| JP | 62-73478 | U | 5/1987 |
| JP | H01-309270 | | 12/1989 |
| JP | H05-114427 | | 5/1993 |
| JP | H08-69828 | | 3/1996 |
| JP | 2000-243532 | A1 | 9/2000 |
| JP | 2004-319338 | A1 | 11/2004 |
| JP | 2005-222821 | | 8/2005 |
| JP | 2005-228710 | A1 | 8/2005 |
| JP | 2005-259502 | | 9/2005 |
| JP | 2008-130564 | A1 | 6/2008 |
| JP | 2008-265964 | | 11/2008 |
| JP | 2009-199801 | A1 | 9/2009 |
| JP | 2009-283363 | A1 | 12/2009 |
| JP | 2010-262861 | A1 | 11/2010 |
| NL | 1026779 | C1 | 9/2005 |
| WO | WO 2008/038331 | A1 | 4/2008 |

OTHER PUBLICATIONS

Japanese Office Action dated Dec. 2, 2014 in the corresponding Japanese patent application No. 2013-550253.

2nd Office Action dispatched on Apr. 19, 2016 from the Chinese Patent Office regarding corresponding Chinese patent application No. 201280062903.1.

Extended European Search Report issued on Jun. 11, 2015 for Application No. 12860193.7.

L'insertion à force dans les circuits imprimés dated Feb. 1, 1990.

Office Action dispatched on Nov. 4, 2015 from the Chinese Patent Office regarding the corresponding Chinese patent application No. 201280062903.1.

* cited by examiner

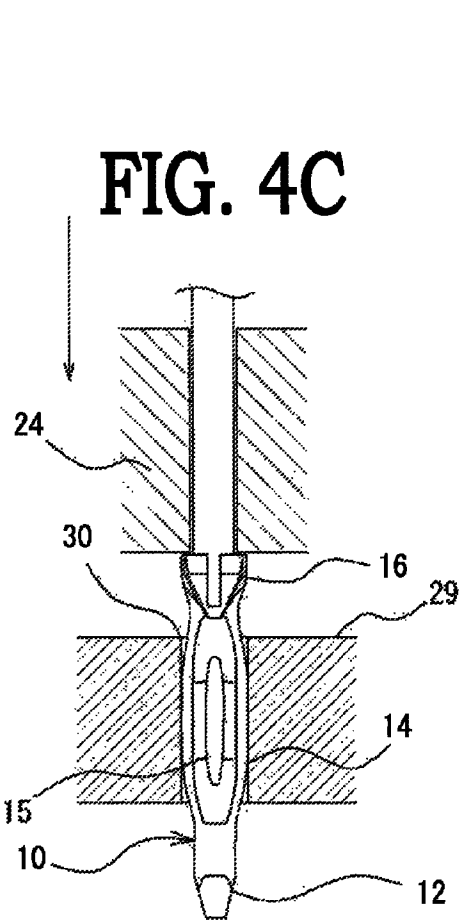
FIG. 4A
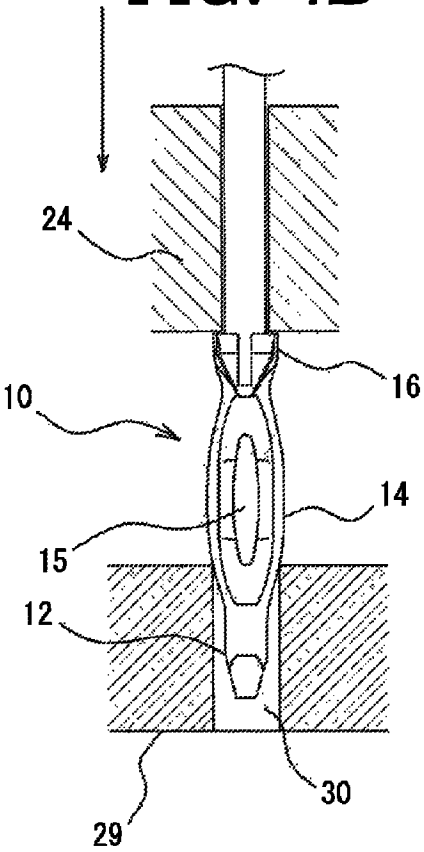
FIG. 4B
FIG. 4C

PRESS-FIT TERMINAL, CONNECTOR AND PRESS-FIT TERMINAL CONTINUOUS BODY EMPLOYING SAME, AND WOUND PRESS-FIT TERMINAL CONTINUOUS BODY

TECHNICAL FIELD

The present invention relates to a press-fit terminal in which a shoulder portion is formed to be pressed by a jig or the like when press-fit into a through hole in a substrate or the like, to a connector and a press-fit terminal continuous body, and to a wound press-fit terminal continuous body. More particularly, the present invention relates to a highly reliable press-fit terminal which is enhanced in the strength of a shoulder portion to ensure stable press fit when pressed by a jig or the like, to a connector and a press-fit terminal continuous body, and to a wound press-fit terminal continuous body.

Press-fit terminals and others with a press-fit portion which is connected by an elastic force instead of soldering when a contact terminal or the like is connected to a through hole in a substrate or the like have become popular in recent years. Being free of soldering for connection to a substrate, press-fit terminals can easily be connected to the substrate and can be mounted and removed repeatedly.

A press-fit terminal as such is connected to a substrate or the like by press fitting with the use of a jig or the like. A direct contact between the press-fit terminal and the jig or the like in press fit can damage the terminal, and a shoulder portion is therefore provided in the press-fit terminal so that the press-fit terminal is press-fit to the substrate by bringing the jig or the like into contact with the shoulder portion.

Press-fit terminal manufacturing methods that are employed are a method of punching a rolled board material by a pressing machine and a method of forming press-fit terminals continuously from a wire material. In the case of press-fit terminals formed from a wire material, a rolling direction in which the wire material is rolled in manufacture runs in the longitudinal direction of the press-fit terminals. This enables the press-fit terminals to withstand a higher pressing force than press-fit terminals that are formed from a board material can when press-fit to a substrate, and therefore reduces damage to the press-fit terminals.

An example of known press-fit terminals that are manufactured from a wire material is described in Patent Literature 1. A press-fit pin described in Patent Literature 1 is, as illustrated in FIG. 11, a press-fit pin 40 made from a wire material for electrical contacts, and includes at least one shoulder portion 41 which is formed unitarily from the material of the press-fit pin.

The press-fit pin disclosed in Patent Literature 1 has an advantage in that there is no need to support the tip side of the press-fit pin with a press-fit tool because the press-fit pin can easily be supported with the press-fit tool around the shoulder portion. Patent Literature 1 also states that a force can be transmitted lengthwise from the press-fit tool to the press-fit pin more easily without damaging the tip side of the press-fit pin.

CITATION LIST

Patent Literature

[PTL 1] JP 2008-130564 A
[PTL 2] JP 2009-283363 A

SUMMARY OF INVENTION

Technical Problems

The shoulder portion and other portions of the press-fit pin described in Patent Literature 1 are formed unitarily from a wire material by rolling or the like. The shoulder portion formed from a wire material by rolling or the like is lacking in strength because a part of the wire material where the shoulder portion is to be formed is stretched laterally, and consequently has a reliability problem in that a pressing force applied when press-fit to a substrate deforms or breaks the shoulder portion. To secure the strength of the part where the shoulder portion of the press-fit pin is to be formed, the shoulder portion cannot be formed large, which means that a part of the shoulder portion that is pressed by a jig or the like is small in area, and gives rise to another reliability problem in that press fit to a substrate is unstable.

A chain of terminals in which terminals are formed continuously can be obtained by forming a terminal from a wire material. An example of such inventions is a terminal continuous body disclosed in Patent Literature 2 given above. However, Patent Literature 2 does not mention a terminal continuous body in which a press-fit portion and a shoulder portion are formed. Patent Literature 1, on the other hand, does not mention press-fit terminals that are continuous with one another.

The present invention has been made to solve the problems inherent in existing technologies, and an object of the present invention is to provide a press-fit terminal in which a press-fit portion and a shoulder portion are formed adjacent to each other, thereby forming a plurality of reinforcement portions for enhancing the strength of the shoulder portion and thus obtaining a shape that can withstand an insertion force with which the press-fit terminal is inserted to a substrate, and in which the shoulder portion is placed a short distance from a substrate surface, thereby allowing the press-fit terminal to be inserted along the central axis of a substrate hole, and thus reducing damage to the substrate as well as breakage of a contact and obtaining a stable insertion force and retaining force, to provide a connector and a press-fit terminal continuous body that use this press-fit terminal, and to provide a wound press-fit terminal continuous body.

Solution to Problems

In order to solve the above-mentioned problems, a press-fit terminal according to a first embodiment of the present invention is a press-fit terminal, including a wire material of a given length, in which the wire material includes: a tip that is formed at one end to be inserted in a substrate; a connection portion that is formed at another end to be connected to an opposite terminal; a press-fit portion that is formed on the tip side of the wire material to be press-fit to the substrate; and a shoulder portion formed on the connection portion side of the press-fit portion.

Further, a press-fit terminal according to a second embodiment of the present invention is configured as follows. In the press-fit terminal of the first embodiment, the shoulder portion has a shoulder portion end adjacent to the connection portion side of the press-fit portion, the shoulder portion end being formed to be large enough to be pressed by a jig.

Further, a press-fit terminal according to a third embodiment of the present invention is configured as follows. In the press-fit terminal of the second embodiment, a part of the shoulder portion that is closest to the press-fit portion is narrower than the shoulder portion end.

Further, a press-fit terminal according to a fourth embodiment of the present invention is configured as follows. In the press-fit terminal of the third embodiment, the shoulder portion has a first reinforcement portion formed along an axis line direction of the wire material.

Further, a press-fit terminal according to a fifth embodiment of the present invention is configured as follows. In the press-fit terminal of the fourth embodiment, the first reinforcement portion is extended in a convex pattern along the axis line direction of the wire material.

Further, a press-fit terminal according to a sixth embodiment of the present invention is configured as follows. In the press-fit terminal of the fifth embodiment, the shoulder portion has a second reinforcement portion that extends, from an end of a portion protruding in a lateral direction of the wire material, in a direction that is at right angles with the lateral direction.

Further, a press-fit terminal according to a seventh embodiment of the present invention is configured as follows. In the press-fit terminal of the first embodiment, the wire material further has a linking portion that links the shoulder portion and the press-fit portion, the linking portion being formed unitarily with the shoulder portion and the press-fit portion between the shoulder portion and the press-fit portion.

Further, a press-fit terminal according to an eighth embodiment of the present invention is configured as follows. In the press-fit terminal of the seventh embodiment, the first reinforcement portion is formed from the shoulder portion to the linking portion.

Further, a press-fit terminal according to a ninth embodiment of the present invention is configured as follows. In the press-fit terminal of the first embodiment, the shoulder portion and the press-fit portion are each formed so as to protrude symmetrically with respect to an axis line direction of the wire material.

Further, a press-fit terminal according to a tenth embodiment of the present invention is configured as follows. In the press-fit terminal of the first embodiment, the press-fit portion has an elongated hole formed in a central portion thereof, the press-fit portion has an outer side surface that is formed to have a thickness that is substantially the same as a thickness of the wire material, and the thickness of the outer side surface decreases toward the elongated hole.

Further, a press-fit terminal according to an eleventh embodiment of the present invention is configured as follows. In the press-fit terminal of the first embodiment, the tip and the connection portion are each tapered toward an end thereof, and a surface at the end of the tip in section and a surface at the end of the connection portion in section are each a twisted-off section.

A connector according to a twelfth embodiment of the present invention is a connector, including a housing with a plurality of openings, the housing being formed from an insulating material, in which the press-fit terminal according to any one of the above-mentioned first to eleventh embodiments is fit to each of the plurality of openings.

A press-fit terminal continuous body according to a thirteenth embodiment of the present invention includes one press-fit terminal according to any one of the above-mentioned first to eleventh embodiments, which is formed after another press-fit terminal continuously in the wire material. The tip of the one press-fit terminal is coupled to the connection portion of the another press-fit terminal.

A wound press-fit terminal continuous body according to a fourteenth embodiment of the present invention includes the press-fit terminal continuous body according to the thirteenth embodiment, which is wound into a coil.

Advantageous Effects of Invention

According to the press-fit terminal of the first embodiment, the press-fit terminal has the shoulder portion, and damage to the press-fit terminal is reduced by bringing a jig into contact with the shoulder portion when the press-fit terminal is press-fit to a substrate. Further, the shoulder portion is formed adjacent to the press-fit portion, which means that the distance between the shoulder portion against which the jig is pressed and a substrate surface to which the press-fit terminal is press-fit can be made short, and that the press-fit terminal can be inserted along the central axis of a substrate hole. Substrate damage and contact breakage are reduced and a stable insertion force and retaining force are obtained as a result in addition, formed from a wire material, the press-fit terminal is stronger against a force in an axis line direction than one formed from a board material by press work, and is accordingly reduced in damage from a pressing force applied in press fit.

According to the press-fit terminal of the second embodiment, the shoulder portion end protruding in the lateral direction of the wire material is formed to have a size that allows the shoulder portion to be pressed by the jig, which means that a pressing force from the jig is received without a loss by the shoulder portion of the press-fit terminal, and the press-fit terminal can thus be inserted smoothly to the substrate. In addition, because the shoulder portion end is formed adjacent to the press-fit portion, the distance between the shoulder portion end and the substrate surface can be closed more, and the press-fit terminal can be inserted to the substrate straight along the central axis of the substrate hole with higher precision. The accuracy and stableness of insertion are thus improved and a force with which the terminal is retained with respect to the substrate is secured as well.

According to the press-fit terminal of the third embodiment, the shoulder portion is formed so that the shoulder portion end is narrower than a part of the shoulder portion that is closest to the press-fit portion, and, when pressed by the jig, thus transmits a pressing force of the jig along the axis line of the press-fit terminal, with the result that the press-fit terminal is inserted straight to the substrate.

According to the press-fit terminal of the fourth embodiment, the first reinforcement portion is formed in the shoulder portion, thereby strengthening the press-fit terminal against a force that is applied in an axial line direction of the shoulder portion, and the shoulder portion thus has less chance of being deformed or broken when pressed by the jig.

According to the press-fit terminal of the fifth embodiment, the first reinforcement portion that is sturdy can be formed by efficiently using the wire material from which the shoulder portion is formed.

According to the press-fit terminal of the sixth embodiment, the second reinforcement portion is formed from the end of the portion protruding in the lateral direction of the shoulder portion, in a direction that is at right angles with the lateral direction, to thereby strengthen the shoulder portion itself and simultaneously secure a wider range that is pressed by the jig, with the result that the accuracy and stability are improved in the insertion of the press-fit terminal to the substrate.

According to the press-fit terminal of the seventh embodiment, the linking portion is formed unitarily between the shoulder portion and the press-fit portion, thereby enhancing the strength of the press-fit terminal than when a portion between the press-fit portion and the shoulder portion is formed separately in the wire material. In addition, with the PF portion and the shoulder portion made closer to each other and unitary with each other, the portion between the shoulder portion and the press-fit portion is reduced in deformation when the shoulder portion is pressed, and is thus strengthened. Moreover, forming the linking portion that is narrower than the shoulder portion and the press-fit portion between the shoulder portion and the press-fit portion narrows the linking portion side of the press-fit portion. The press-fit portion can accordingly obtain a satisfactory elastic force larger than when the press-fit portion is formed directly from the width of the shoulder portion. When the sectional area of the linking portion is given as S and the sectional area of the wire material is given as A, it is preferred to set the thickness of the linking portion so that the sectional area S of the linking portion satisfies $A \geq S \geq 0.9A$. This way, the linking portion is formed at a thickness that is the same or substantially the same as the wire material in sectional area, and the resultant linking portion is sturdier.

According to the press-fit terminal of the eighth embodiment, a portion that links the shoulder portion and the linking portion is made sturdy by forming the first reinforcement portion from the shoulder portion to the linking portion, with the result that buckling or the like is reduced more.

According to the press-fit terminal of the ninth embodiment, the shoulder portion and the press-fit portion are formed symmetrically, which allows the shoulder portion to be pressed by the jig with an even pressure and allows the press-fit portion to be deformed evenly. Buckling or the like is reduced more as a result.

According to the press-fit terminal of the tenth embodiment, an efficient press-fit portion can be formed, which utilizes the limited material of a wire material to the fullest in terms of size and elastic force.

According to the press-fit terminal of the eleventh embodiment, the press-fit terminal formed from the wire material is separated from the wire material into an individual terminal by twisting the press-fit terminal, which gives the tip end and connection portion end of the press-fit terminal a twisted-off, whirl-like, section, and prevents a burr which is generated if the press-fit terminal is sheared.

According to the connector of the twelfth embodiment, a connector that has the effects of the press-fit terminal of any one of the first to eleventh embodiments is obtained.

According to the press-fit terminal continuous body of the thirteenth embodiment, a press-fit terminal continuous body is obtained in which press-fit terminals having the effects of any one of the first to eleventh embodiments are formed continuously. By forming a taper which is tapered toward a portion that couples the tip and the connection portion so that the coupling portion is thinnest, each press-fit terminal can easily be separated from the press-fit terminal continuous body at the coupling portion by twisting off, and the chance of a burr is reduced more.

According to the wound press-fit terminal continuous body of the fourteenth embodiment, a long press-fit terminal continuous body is made into a wound body, thereby improving the ease and efficiency in the carrying and storing of the press-fit terminal continuous body. When formed, the wound press-fit terminal continuous body may be wound around a cylindrical member that serves as a core, such as a roll or a bobbin. This facilitates the carrying and storing of the press-fit terminal continuous body even more and improves work efficiency.

BRIEF DESCRIPTION OF DRAWINGS

FIG. 4A is a diagram illustrating a pre-fitting state of the press-fit terminal according to the embodiment, FIG. 4B is a diagram illustrating a state of the press-fit terminal under the press-fitting process, and FIG. 4C is a diagram illustrating a post-fitting state of the press-fit terminal.

DESCRIPTION OF EMBODIMENTS

Embodiments of the present invention are described below with reference to the drawings. However, the following embodiments are exemplifications of a press-fit terminal that embodies the technical concept of the present invention, and are not intended to limit the present invention to the embodiments. The present invention is equally applicable to other embodiments that are included in the scope of patent claims.

First Embodiment

Figures 1A, 1B, 1C, 1D:
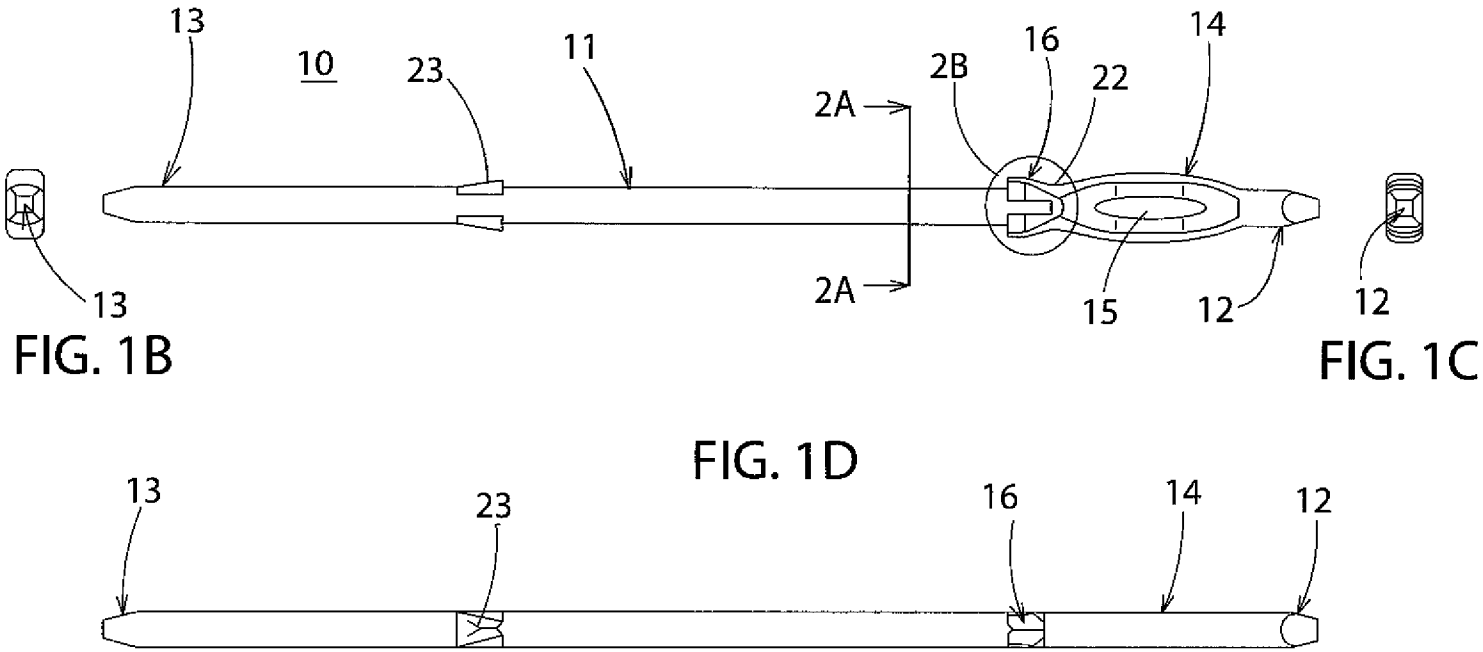
FIG. 1A is a top view of a press-fit terminal according to an embodiment of the present invention.
FIG. 1B is a rear view thereof.
FIG. 1C is a frontal view thereof.
FIG. 1D is a side view thereof.
Figure 2A:
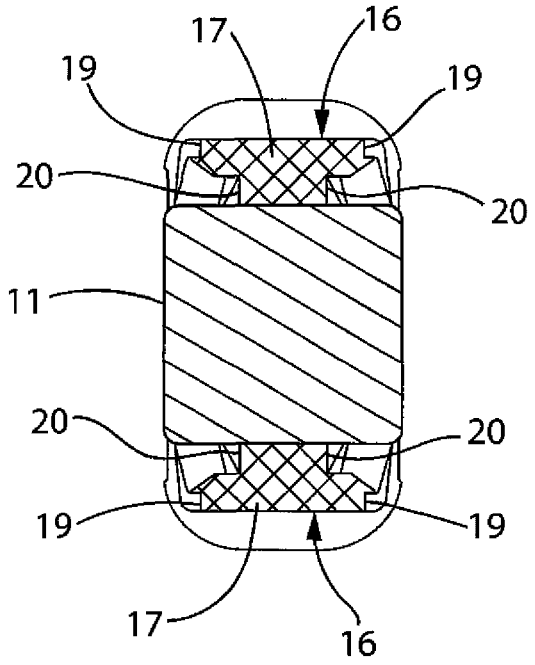
FIG. 2A is a sectional view taken along the line 2A-2A of FIG. 1A.
Figure 2B:
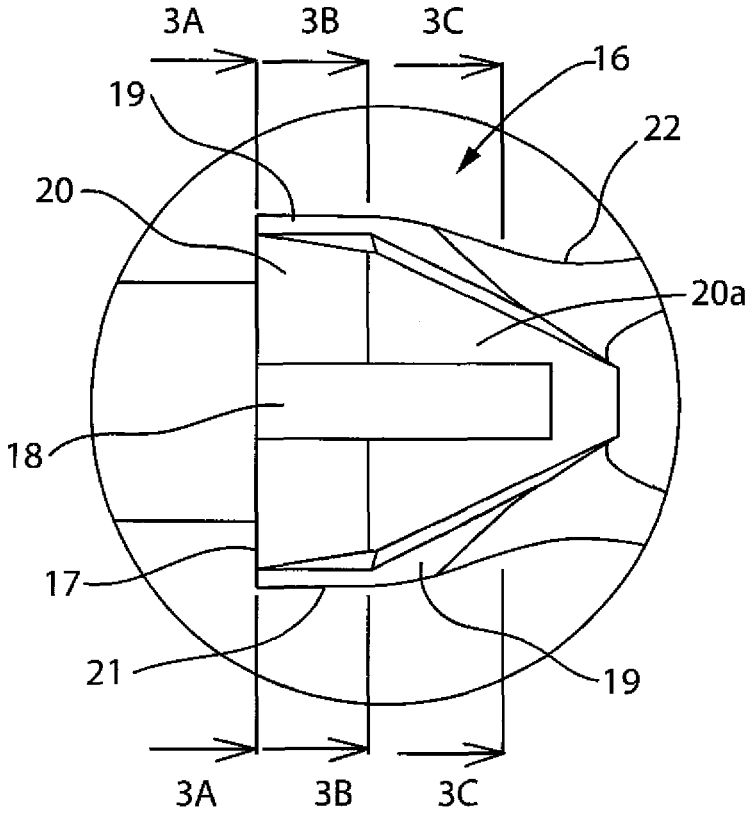
FIG. 2B is an enlarged view of a portion 2B of FIG. 1A.
Figure 3A:
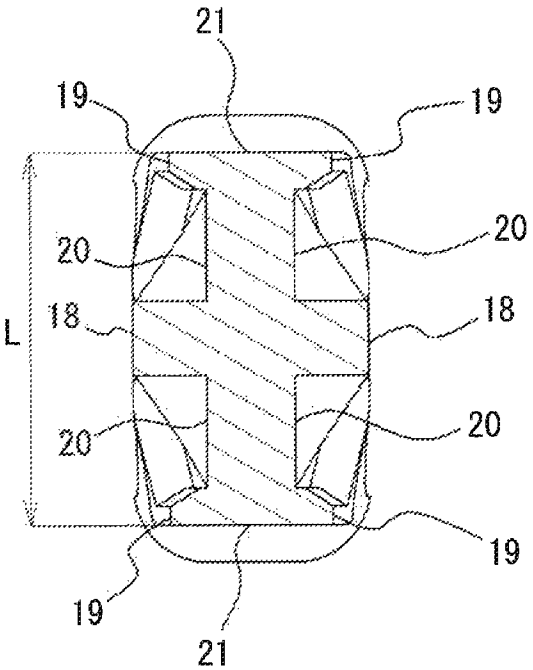
FIG. 3A is a sectional view taken along the line 3A-3A of FIG. 2A.
Figure 3B:
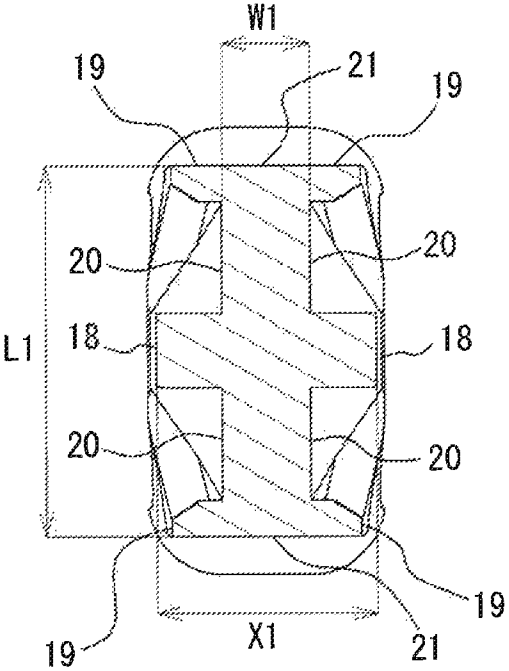
FIG. 3B is a sectional view taken along the line 3B-3B of FIG. 2A.
Figure 3C:
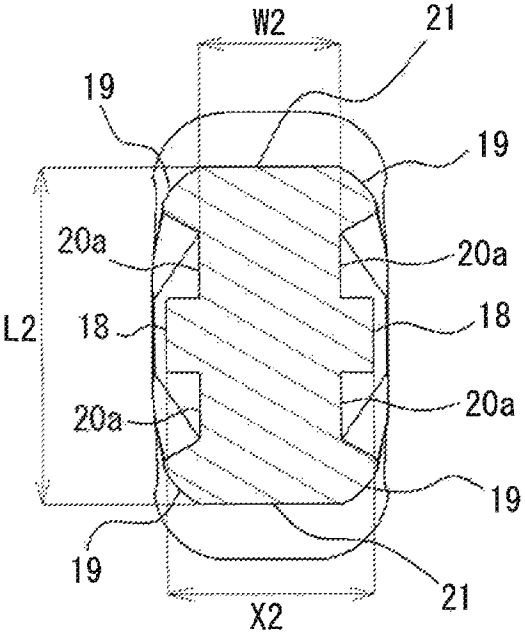
FIG. 3C is a sectional view taken along the line 3C-3C of FIG. 2A.

A press-fit terminal according to an embodiment of the present invention is described with reference to FIG. 1 to FIG. 3. A press-fit terminal (hereinafter referred to as "PF terminal") 10 according to a first embodiment of the present invention is formed by giving a long wire material 11A the shape of a PF terminal at regular intervals by press work or the like (see FIGS. 9A and 9B), and then separating the wire material 11A into wire material pieces 11 each having a given length as individual PF terminals. In the PF terminal 10, a tip 12 which is inserted to a substrate is formed at one end of the wire material piece 11, and a connection portion 13 which is connected to an opposite terminal is formed at the other end of the wire material piece 11. A press-fit portion (hereinafter referred to as "PF portion") 14 which is press-fit to the substrate is formed on the side of the tip 12 of the wire material piece 11. A shoulder portion 16 is formed adjacent to the PF portion 14 above the PF portion 14, in other words, on the side of the wire material piece 11 where the connection portion 13 is formed.

The wire material piece 11 is obtained by stretching stainless steel, an iron-nickel alloy, copper, a copper alloy, or the like via rolling, performing plating and thereby forming the long wire material 11A (see FIGS. 9A and 9B), and separating the wire material 11A into pieces of a given length. PF terminal shapes are formed continuously when the long wire material is formed (see FIGS. 9A and 9B). Formed from a wire material, the PF terminal 10 is stronger against a force in an axial line direction than one that is formed from a board material by press work, and has less chance of damage to the tip from a pressing force that is applied in press fit. The PF terminal, which is shaped like a chamfered square in section in the embodiment (see FIG. 2A), is not limited thereto and can have any shape in section into which a wire material can be formed, such as a circular shape, an elliptical shape, or a rectangular shape. Now, the structure of the PF terminal is described.

The tip 12 is a portion for leading the PF terminal 10 accurately to a given through hole when the PF terminal 10 is fit to a through hole in a substrate or the like. The tip 12 is therefore provided with a taper 12*a* so as to be tapered and ensure easy insertion to a through hole.

The connection portion 13 is a portion that is connected to an opposite terminal. The connection portion 13 can therefore be formed into an arbitrary shape that suits the opposite terminal. The connection portion 13 of the embodiment is, similarly to the tip 12, provided with a taper 13*a* so as to be tapered. The tip 12 and the connection portion 13 are shaped by press work.

Figure 9A:
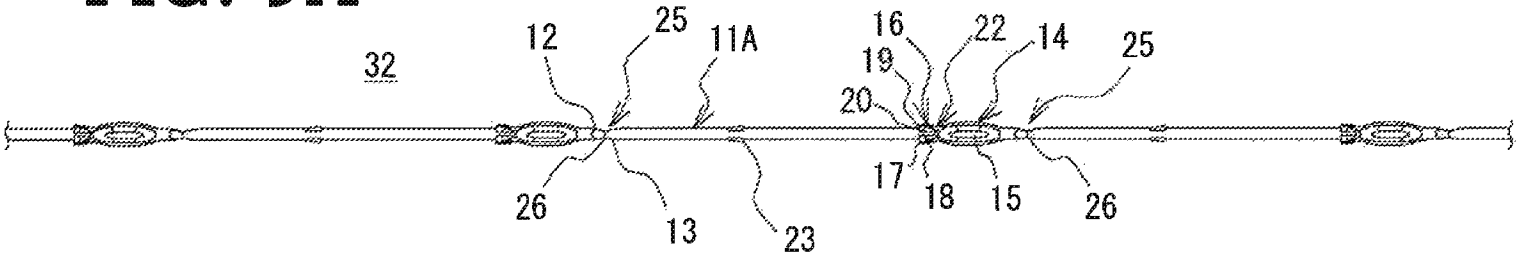
FIG. 9A is a top view of a part of a press-fit terminal continuous body.
Figure 9B:
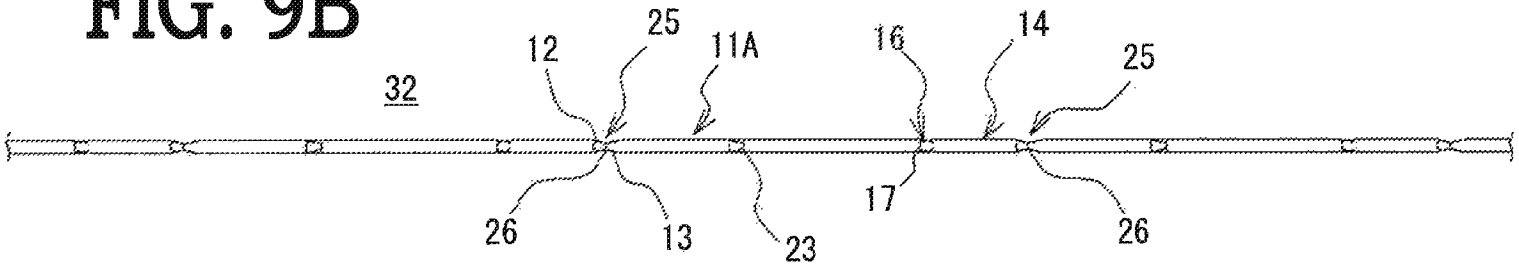
FIG. 9B is a side view thereof.
Figure 9C:
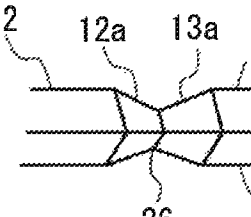
FIGS. 9C and 9D are enlarged views illustrating the separation of the press-fit terminal continuous body.
Figure 9D:
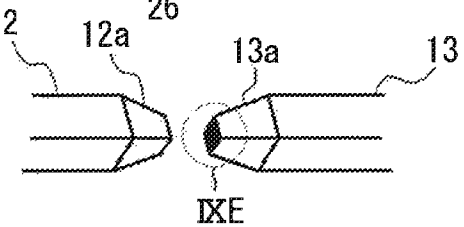
Figure 9E:
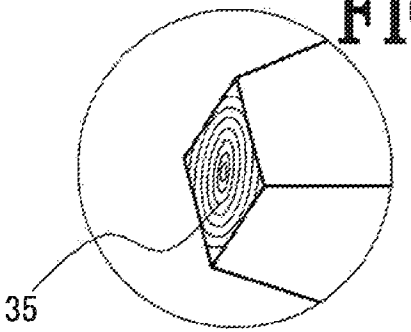
FIG. 9E is an enlarged view of a portion IXE of FIG. 9D.

The surface at the end of the tip 12 and the surface of at the end of the connection portion 13 each have a whirl-like section 35 (see FIG. 9E). This whirl is shaped because press-fit terminals formed continuously in the long wire material 11A are separated from one another by rotating the press-fit terminal that is to be separated against the wire material-side press-fit terminal and twisting off (see FIGS. 9C and 9D). A burr which is generated if the press-fit terminal is sheared can thus be prevented.

The PF portion 14 is formed on the tip 12 side of the wire material piece 11, and protrudes laterally and symmetrically with respect to the axis line of the wire material piece 11 so as to be wider than the width of the wire material piece 11. In order to form the spread shape of the PF portion 14, a hole 15 which is in proportion to the size of the PF portion 14 is provided in the central portion of the PF portion 14. Forming the hole 15 laterally spreads the volume of the wire material piece 11 corresponding to the hole 15, with the result that the PF portion 14 is formed. The PF portion 14 is formed by a plurality of press work sessions so as to be adjacent to the shoulder portion, which is described later. The PF portion 14 can be deformed elastically by forming the hole 15.

The lateral spread of the PF portion 14 can be adjusted based on the diameter of a through hole that is formed in a substrate to which the PF terminal 10 is to be inserted, and is made larger than the diameter of the through hole. This way, when the PF terminal is inserted to the substrate, the PF portion is elastically deformed by a pressure received from the through hole in the substrate, and is fixed and connected to the through hole by an elastic force generated by the elastic deformation.

A strong PF portion can be formed efficiently without making the hole in the PF portion too large by forming an outer surface of the PF portion to a thickness that is substantially the same as the wire material's thickness and decreasing the thickness toward the hole when the PF portion 14 is formed, instead of simply forming the hole 15 in the PF portion 14.

The shoulder portion 16 is described next. The shoulder portion 16 is formed so as to protrude symmetrically with respect to the axis line of the wire material piece 11 in the same direction as the lateral direction in which the PF portion 14 is protruded. The shoulder portion 16 is a portion that receives a pressing force from a jig or the like when the PF terminal 10 is press-fit to the substrate, and is formed adjacent to the PF portion 14 described above. The shoulder portion 16 is provided with a shoulder portion end 17, which is pressed by a jig or the like and which is formed to have a size (area) that enables the jig or the like to press the shoulder portion end 17. The shoulder portion 16 is formed adjacent to the PF portion 14. With the PF portion 14 and the shoulder portion 16 formed adjacent to each other, the distance between the shoulder portion end 17 which is pressed by a jig and a substrate surface is closer than in the related art.

Because the shoulder portion 16 is thus formed adjacent to the PF portion 14 and the distance is shortened between the shoulder portion against which a jig is pressed and a substrate surface to which the PF terminal 10 is press fit, the press-fit terminal can be inserted along the central axis of a substrate hole. Consequently, the press-fit terminal can be inserted straight along the central axis of the substrate hole with precision, which improves the accuracy and stability of insertion and secures a satisfactory terminal retaining force with respect to the substrate.

The shoulder portion 16 is formed to have a substantially pentagonal shape in which a width L of the shoulder portion end 17 is widest, and the portion having width L is elongated a bit along the axis of the PF terminal 10 and a part of the shoulder portion 16 that is closest to the PF portion 14 is narrowed. The forming of the shoulder portion 16 involves spreading the wire material piece 11 laterally by pressing, with the result that a rolled portion 20 which is stretched thinner than the section of the wire material piece 11 is formed in the shoulder portion 16. However, the strength of the shoulder portion 16 cannot be maintained by the rolled portion 20 alone. A first reinforcement portion 18 and a second reinforcement portion 19 are therefore formed unitarily in the shoulder portion 16 in order to obtain the necessary strength.

The first reinforcement portion 18 is a convex rib formed along the axis line direction of the wire material piece 11 in the central portion of the shoulder portion 16. Forming the first reinforcement portion 18 in the shoulder portion 16 along the axis line direction of the wire material piece 11 strengthens the shoulder portion 16 against a force applied in an axis line direction of the shoulder portion 16. The first reinforcement portion 18 reaches a linking portion 22, which is described later (see FIG. 2B). The second reinforcement portion 19 is formed by extending an end of the rolled portion 20 that protrudes in the lateral direction of the shoulder portion 16 in a direction that is at right angles with the lateral direction. In short, the second reinforcement portion 19 is formed to have the shape of the letter "T" in section. Forming the second reinforcement portion 19 in this manner strengthens the shoulder portion itself and also secures wider range to be pressed by a jig or the like.

The rolled portion 20 includes a slope 20*a* sloped toward a direction in which the shape of the shoulder portion 16 is narrowed. In other words, the protrusion in the lateral direction decreases which increases the thickness of the rolled portion 20. Specifically, a comparison between FIG. 3B and FIG. 3C which are sectional views taken along different lines shows that a width W1 of the lateral protrusion in FIG. 3B and a width W2 of a similar portion in FIG. 3C satisfy W1<W2. A width X1 of the first reinforcement portion in FIG. 3B and a width X2 of a similar portion in FIG. 3C satisfy X1>X2. A width L1 of the second reinforcement portion in FIG. 3B and a width L2 of a similar portion in FIG. 3C satisfy L1>L2.

Then, the second reinforcement portion 19 which is formed along the shape of an outer surface 21 of the shoulder portion 16 makes the shoulder portion sturdier. Specifically, the part where the shoulder portion 16 narrows is susceptible to deformation from a large pressing force that is received by the shoulder portion end 17 of the shoulder portion 16 and transmitted in the axis line direction of the PF terminal 10, but is made sturdy by the first reinforcement portion 18 and the second reinforcement portion 19 and is accordingly reduced in breakage and damage.

The linking portion 22 is formed between the PF portion 14 and the shoulder portion 16. The linking portion 22 is formed unitarily with the PF portion 14 and the shoulder portion 16, and is a portion that follows the narrowed part of the shoulder portion 16 to link the shoulder portion 16 and the PF portion 14. A high strength is obtained by forming the linking portion 22 so that the sectional area of the linking portion 22 is the same or substantially the same as the sectional area of the wire material piece 11. Specifically, when the sectional area of the linking portion is given as S and the sectional area of the wire material piece 11 is given as A, it is preferred for the sectional area S of the linking portion 22 to satisfy $A \geq S \geq 0.9A$. Forming the linking portion 22 unitarily with the PF portion 14 and the shoulder portion 16 imparts a higher strength than when the linking portion 22 is formed separately from the PF portion 14 and the shoulder portion 16, pushes the adjacent PF portion 14 and shoulder portion 16 closer to each other, and closes the distance between the shoulder portion 16 and the substrate surface.

Forming the first reinforcement portion 18 and the second reinforcement portion 19 in the shoulder portion 16 in this manner improves the accuracy and stability in the insertion of the PF terminal 10 to a substrate, and reduces the deformation and breakage of the shoulder portion pressed by a jig. The first reinforcement portion 18 formed in the shoulder portion 16 is extended to the linking portion 22. With the first reinforcement portion 18 thus covering a portion that links the shoulder portion 16 and the linking portion 22, the PF terminal 10 is made sturdier and buckling or the like can be reduced. In addition, forming the linking portion which is narrower than the shoulder portion and the press-fit portion between the shoulder portion and the press-fit portion narrows the linking portion side of the press-fit portion, which gives the press-fit portion a satisfactory elastic force larger than when the press-fit portion is formed directly from the width of the shoulder portion.

The shoulder portion of the PF terminal is not limited to the substantially pentagonal shape described in the embodiment, and can have any shape in which the shoulder portion end is large enough to be pressed by a jig or the like and a portion closest to the PF portion is narrower than the width of the shoulder portion end. For instance, the shoulder portion may be formed into a triangular shape, a semicircular shape or a semi-elliptical shape which is formed from curves, a hexagonal shape or a gourd-like shape which includes a portion protruding from the shoulder portion end, or shapes approximate to these shapes. When the shoulder portion has such a shape, too, the first reinforcement portion and the second reinforcement portion can be formed and the linking portion can be formed between the PF portion and the shoulder portion, which means that the effects of the present invention described above are obtained.

A push-in portion 23 is formed on the connection portion 13 side of the PF terminal 10. The push-in portion 23 is a portion that is press-fit to a housing or the like to serve as a stopper. The push-in portion 23 can therefore be formed to have an arbitrary size and shape to suit the housing or the like that is used.

The fitting of the PF terminal of the embodiment to a substrate is described next with reference to FIG. 4. In order to fit the PF terminal 10 to a substrate 29, the PF terminal 10 is first placed where a through hole 30 is formed in the substrate 29 (see FIG. 4A). The tip 12 of the PF terminal 10 is then positioned with respect to the through hole 30 and inserted until the PF portion 14 comes into abutment against the through hole 30 (see FIG. 4B). The PF portion 14 is formed larger than the diameter of the through hole 30, and inserting the PF portion 14 into the through hole 30 requires a pressing force large enough to deform the PF portion 14. A jig 24 is therefore used to press and insert the PF terminal 10. At this point, the jig 24 is brought into contact with the shoulder portion 16 formed in the PF terminal 10 to press the shoulder portion 16, to thereby deform the PF portion 14 and press-fit the PF portion 14 into the through hole 30. This press fit is continued until a given point is reached, and the PF terminal 10 is thus fixed and connected by an elastic force generated by the deformation of the PF portion 14 (see FIG. 4C). While FIG. 4 illustrate a case where one PF terminal 10 is inserted, a plurality of PF terminals may be connected to a plurality of through holes. In this case, the plurality of PF terminals may be connected one at a time, or may be connected at once.

Application Example 1

Figure 5A:
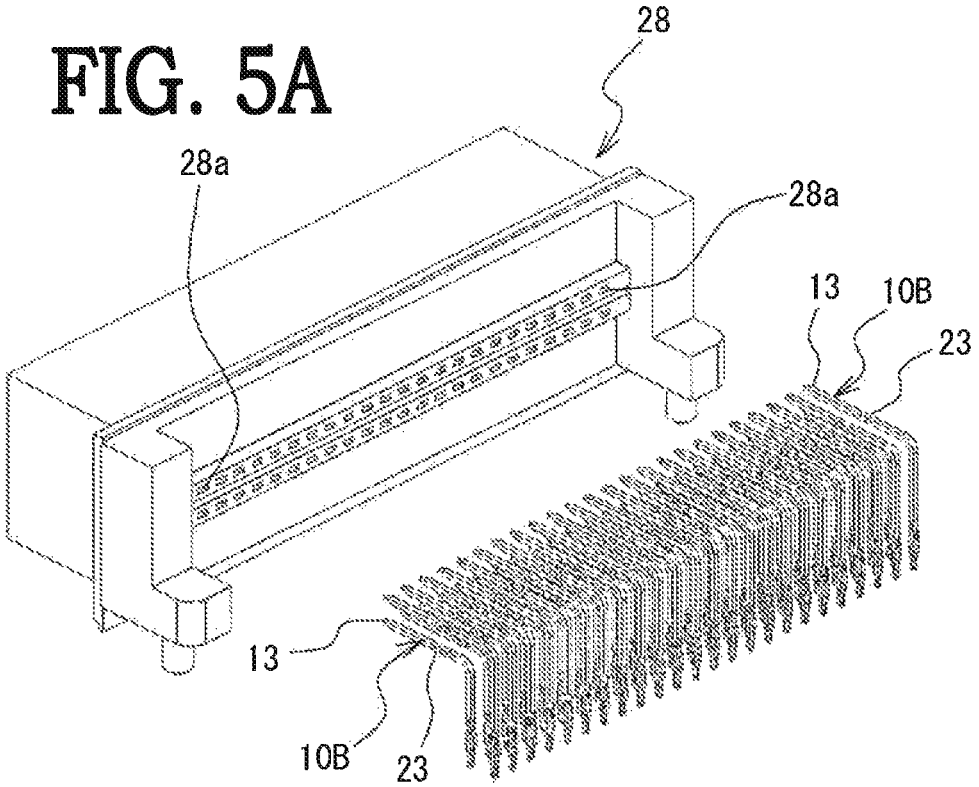
FIG. 5A is a perspective view illustrating an example of the mode in which the press-fit terminal of the embodiment is used.
Figure 5B:
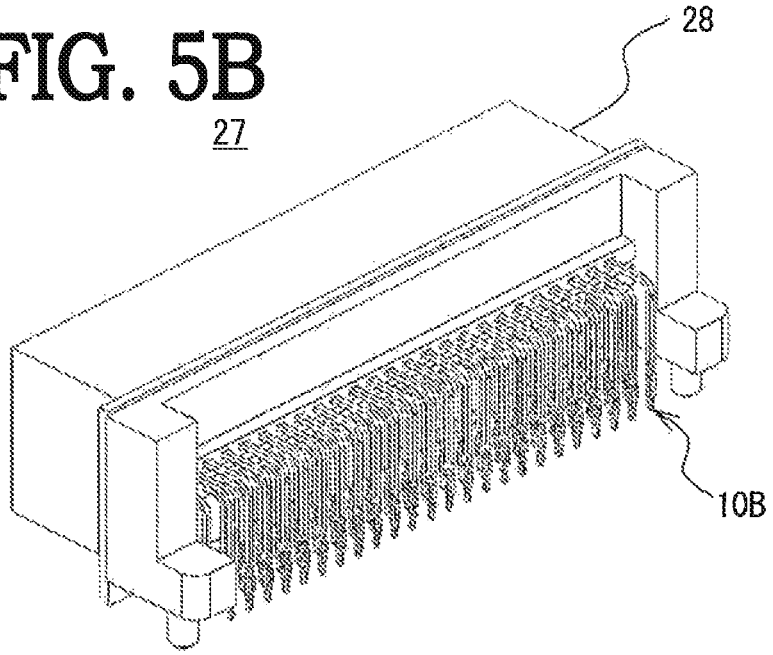
FIG. 5B is a perspective view illustrating the subsequence of FIG. 5A.

A connector 27 which uses the PF terminal 10 is described next as Application Example 1 of the mode in which the PF terminal of the embodiment is used. First, as illustrated in FIG. 5A, linearly formed PF terminals are each bent at a substantially right angle at the center of the PF terminal to prepare a plurality of PF terminals 10B. A housing 28 made of a synthetic resin is prepared, which similarly has a plurality of through holes 28*a* to fit the prepared plurality of PF terminals 10B therein. The connection portion 13 of each of the plurality of PF terminals 10B is inserted into one of the through holes 28*a* in the housing 28 until a given point is reached (see FIG. 5B).

At this point, the push-in portion 23 formed on the connection portion 13 side of the PF terminal 10B is press-fit into the through hole 28*a* of the housing 28, to thereby serve as a stopper. The plurality of PF terminals 10B may be inserted to the housing 28 one at a time or may be inserted at once. This completes the assembly of the connector 27 which includes the PF terminals 10B. A connector that includes the PF terminal according to the embodiment can be formed in this manner. A housing to which the PF terminal is fit can be selected from various shapes to suit the mode in which the connector is used and, accordingly, a highly versatile connector is obtained.

Figure 6A:
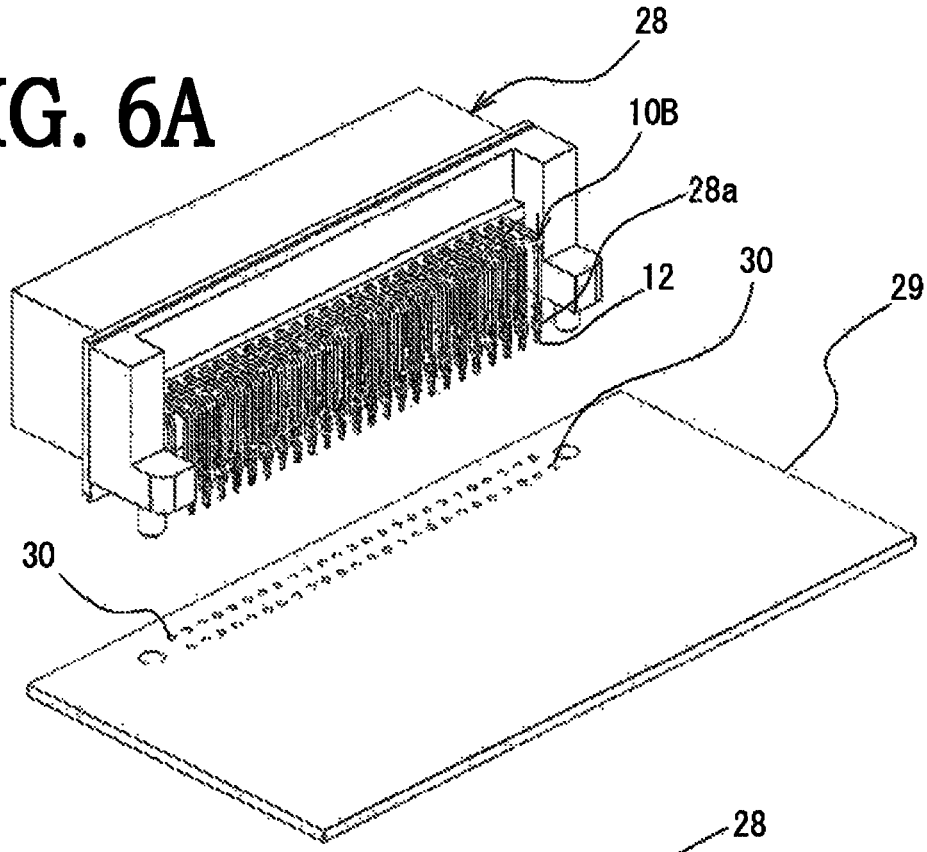
FIG. 6A is a perspective view illustrating the subsequence of FIG. 5B.
Figure 6B:
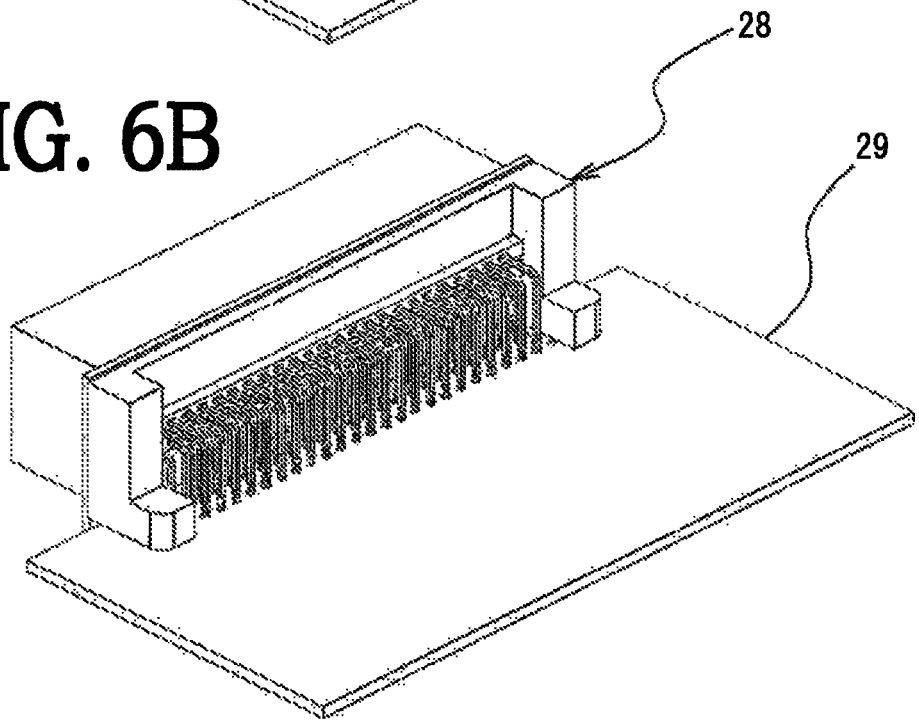
FIG. 6B is a perspective view illustrating the subsequence of FIG. 6A.

The completed connector 27 is next connected to the substrate 29. As illustrated in FIG. 6A, the connector 27 is positioned with respect to the substrate 29, where as many through holes 30 as the number of the plurality of PF terminals 10B fit to the connector 27 are formed, and the tip 12 of each PF terminal 10B is inserted into one of the through holes 30. A jig or the like is used to press-fit the PF portion 14 of the PF terminal 10B to the through hole 30, and this press fit is conducted between given points, thereby completing the connecting of the connector 27 to the substrate 29 (see FIG. 6B).

Application Example 2

Figure 7A:
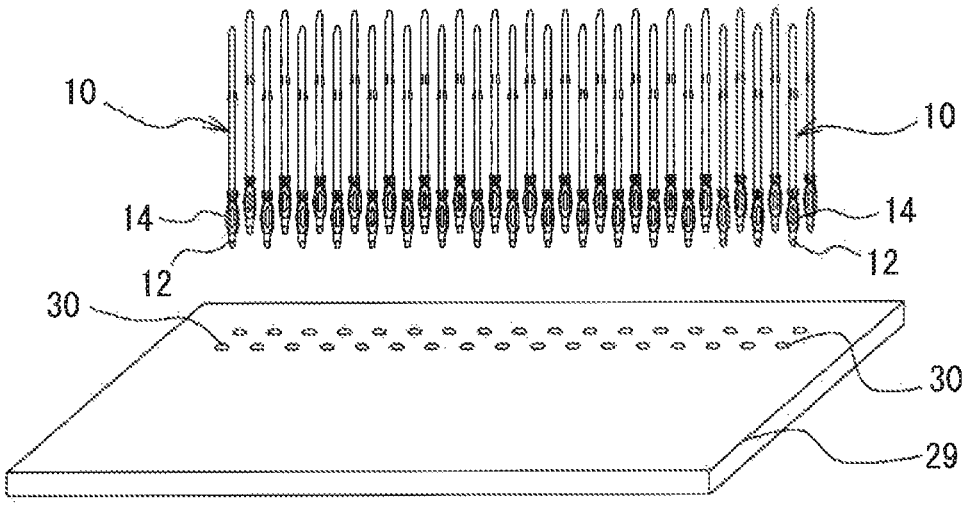
FIG. 7A is a perspective view illustrating another example of the mode in which the press-fit terminal of the embodiment is used.
Figure 7B:
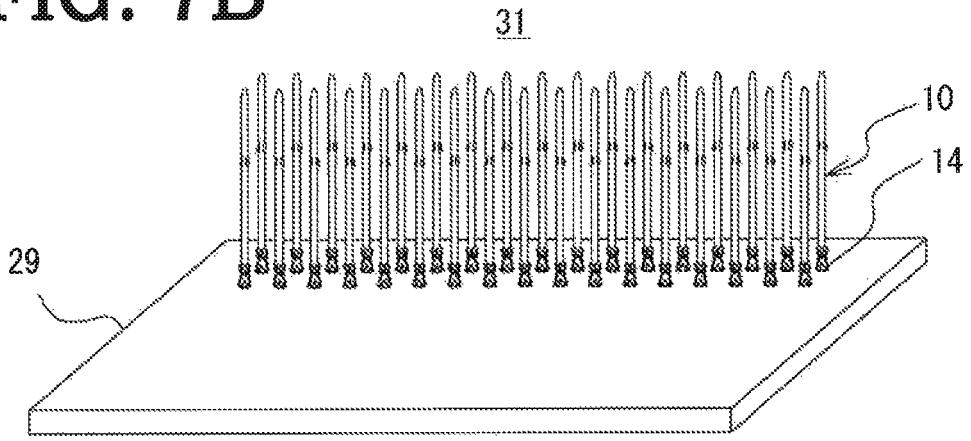
FIG. 7B is a perspective view illustrating the subsequence of FIG. 7A.

Application Example 2 is described as another mode in which the PF terminal 10 is used. Application Example 2 involves first connecting a plurality of PF terminals 10 of the embodiment to the through holes 30 of the substrate 29. This connection is accomplished by positioning the plurality of PF terminals 10 with respect to the plurality of through holes 30 formed in the substrate 29 (see FIG. 7A), and then press-fitting the plurality of PF terminals 10 to the through holes 30 with the use of a jig or the like (see FIG. 7B). The PF terminals 10 which are linear terminals in Application Example 2 may instead be bent terminals. The PF terminals 10 may also be distributed in the form of a unit 31 in which the PF terminals 10 are connected to the substrate 29.

Figure 8A:
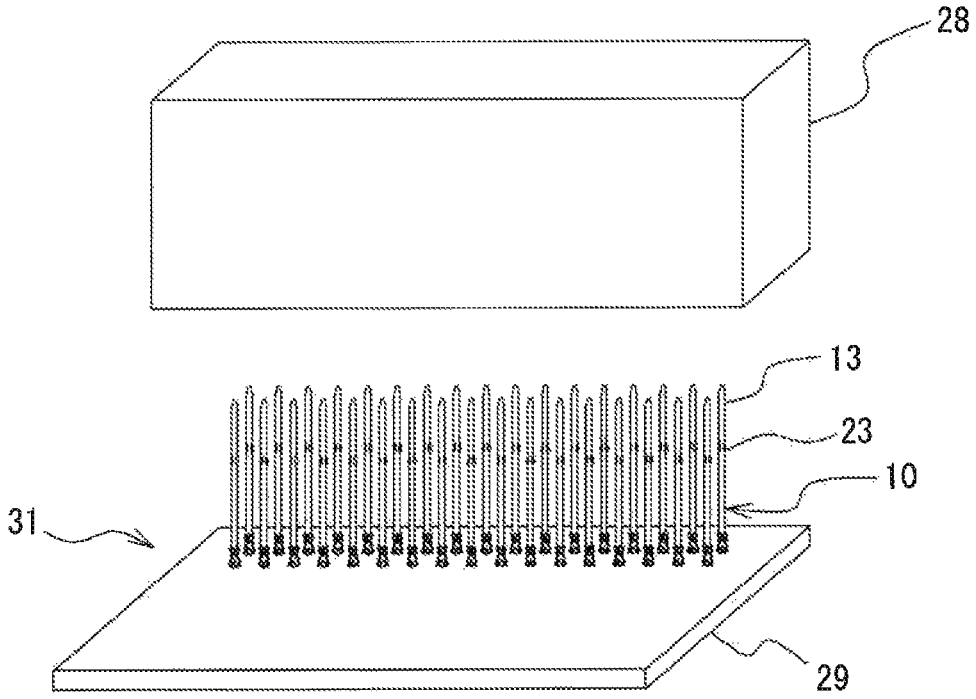
FIG. 8A is a perspective view illustrating the subsequence of FIG. 7B.
Figure 8B:
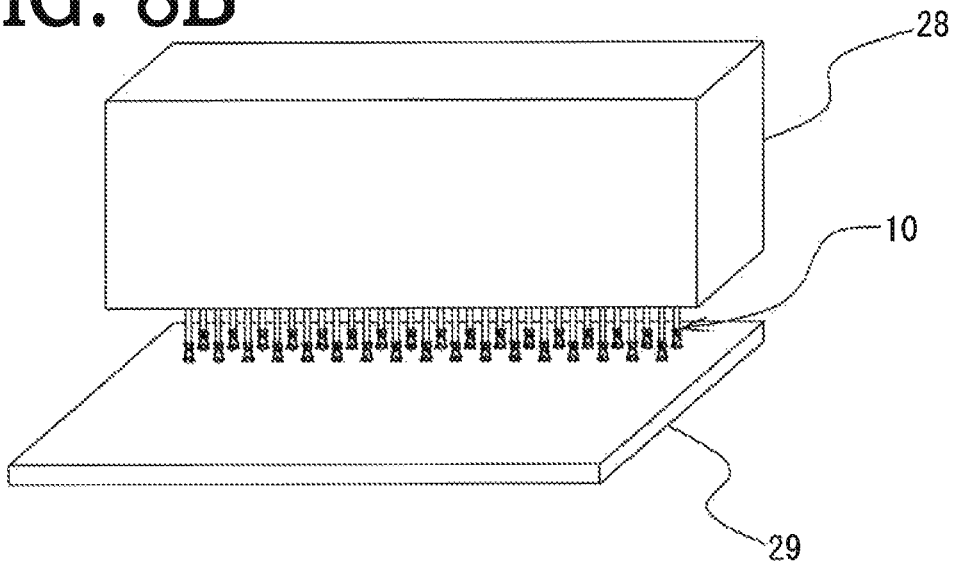
FIG. 8B is a perspective view illustrating the subsequence of FIG. 8A.

Next, a housing 28 is mounted to the unit 31 in which the PF terminals 10 are connected to the substrate 29 (see FIG. 8A). The mounting of the housing 28 is accomplished by inserting the connection portion 13 of each PF terminal 10 to one of through holes (not shown) formed in the housing 28, and press-fitting the push-in portion 23 (see FIG. 8B). The PF terminal 10 is fit to the housing 28 in this manner. The PP terminal can thus be put into a wide range of uses.

Second Embodiment

A second embodiment of the present invention discusses a press-fit terminal continuous body (hereinafter referred to as PF terminal continuous body) 32 which is obtained by forming one PF terminal 10 described in the first embodiment after another continuously in a wire material. Components that are common to the first and second embodiments are denoted by the same symbols, and detailed descriptions thereof are omitted.

The PF terminal continuous body 32 is, as illustrated in FIGS. 9A and 9B, the long wire material 11A in which the PF terminals 10 of the first embodiment are formed continuously, and is at a stage prior to the separation of the wire material into individual PF terminals 10 of the first embodiment as described above.

The PF terminal continuous body 32 at this stage is formed as a single near member in which the end of the tip 12 of one PF terminal 10 is coupled to the end of the connection portion 13 of another PF terminal 10. The portion where the tip 12 and the connection portion 13 are coupled is a coupling portion 25. The taper 12*a* formed in the tip 12 and the taper 13*a* formed in the connection portion 13 are coupled in the coupling portion 25, thereby creating a valley portion 26 at the center of the coupling portion 25. The bottom of the valley portion 26 is where the PF terminals 10 are separated into individual terminals by twisting off. The separation by twisting off prevents a burr which is generated in the section if the PF terminal 10 is sheared (see FIGS. 9C to 9E). The PF terminal continuous body 32 as a piece of wire material in which the PF terminals 10 of the first embodiment are formed in this manner makes a plurality of PF terminals 10 easy to handle during transfer, transportation, carrying-in, and the like.

Figure 10A:
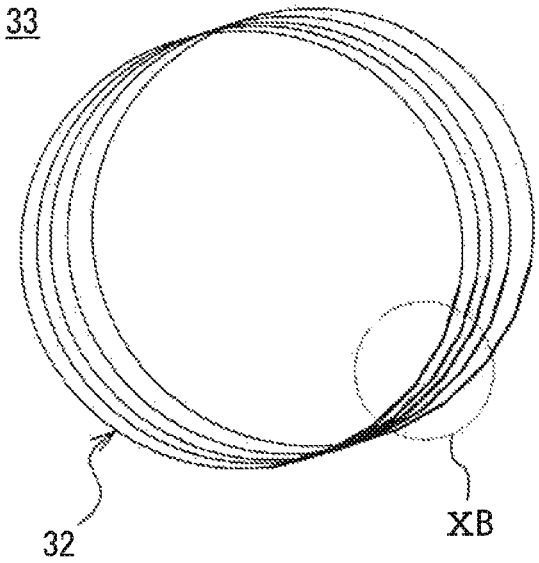
FIG. 10A is a perspective view of a wound press-fit terminal continuous body.
Figure 10B:
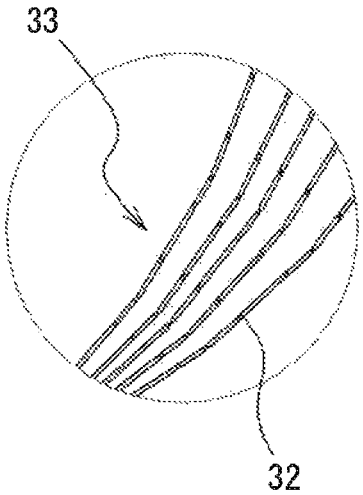
FIG. 10B is an enlarged view of a portion XB of FIG. 10A.
Figure 10C:
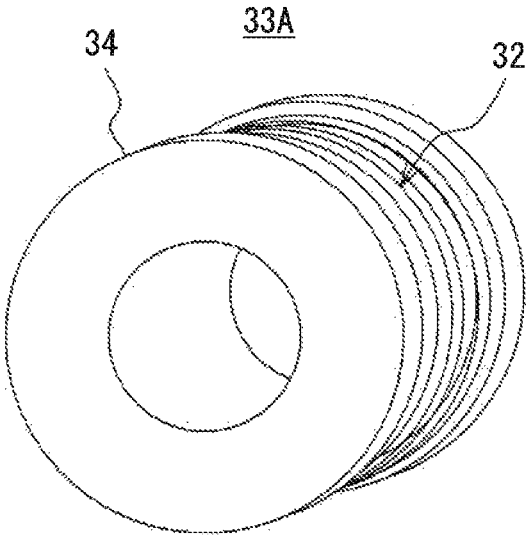
FIG. 10C is a perspective view of the wound press-fit terminal continuous body that is wound around a cylindrical member.
Figure 10D:
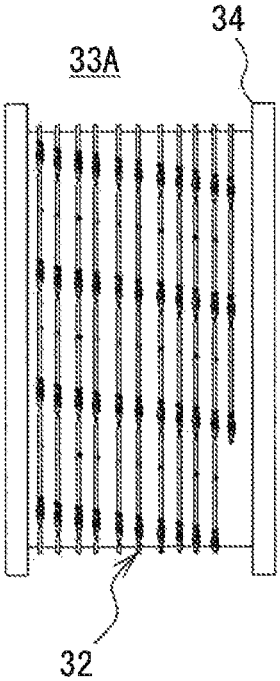
FIG. 10D is a frontal view thereof.
Figure 11:
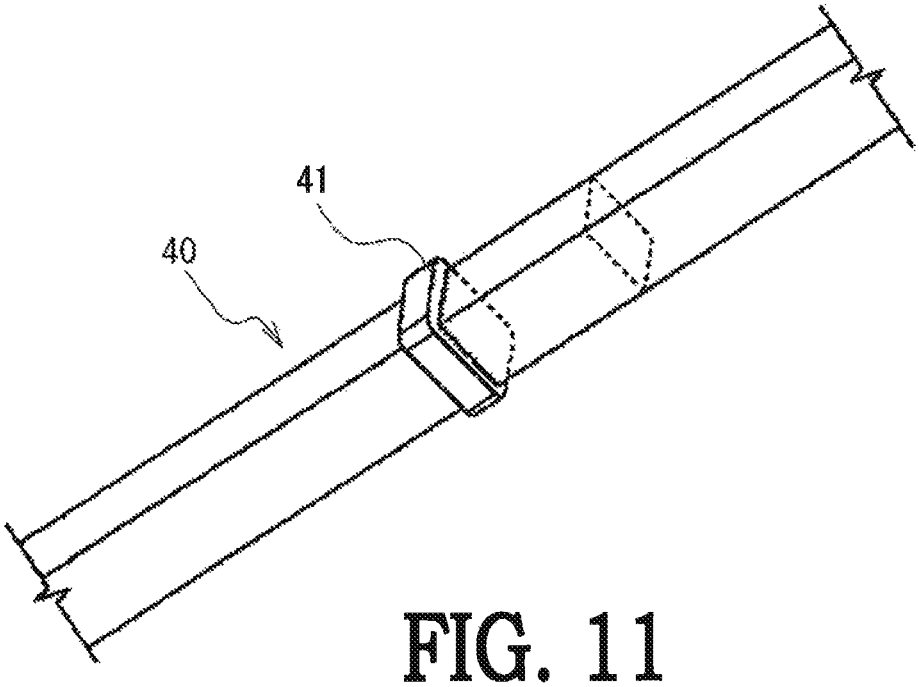
FIG. 11 (PRIOR ART)
FIG. 11 is a perspective view illustrating an existing technology.

The ease of handling is enhanced in a wound PF terminal continuous body 33, where the PF terminal continuous body 32 is wound into a coil that has a relatively large diameter as illustrated in FIGS. 10A and 10B, and in a wound PF terminal continuous body 33A, where the PF terminal continuous body 32 is wound around a cylindrical member 34 that serves as a core, such as a roll or a bobbin, as illustrated in FIGS. 10C and 10D. The bobbin or the like may be set in a press-fitting device for successive press-fitting to a substrate and a housing when the PF terminal continuous body 32 is loaded into the press-fitting device. The PF terminal continuous body 32 may also be transported or sold in the form of the wound PF terminal continuous body 33A in which the PF terminal continuous body is wound around the bobbin or the like.

REFERENCE SIGNS LIST

10, 10B; press-fit (PF) terminal
11: wire material piece
11A: long wire material
12: tip
12*a*: taper
13: connection portion
13*a*: taper
14: press-fit (PF) portion
15: hole
16: shoulder portion
17: shoulder portion end
18: first reinforcement portion
19: second reinforcement portion
20: rolled portion
20*a*: slope
21: outer surface
22: linking portion
23: push-in portion
24: jig
25: coupling portion
26: valley portion
27: connector
28: housing
28*a*: through hole
29: substrate
30: through hole
31: unit
32: press-fit terminal continuous body
33, 33A: wound press-fit terminal continuous body
34: cylindrical member
35: section

The invention claimed is:

1. A press-fit terminal, made up of a wire material of a given length, the press-fit terminal comprising:

a tip that is formed on the wire material at one end to be inserted in a substrate;

a connection portion that is formed on the wire material at another end to be connected to an opposite terminal;

a press-fit portion that is formed on the tip side of the wire material to be press-fit to the substrate; and a shoulder portion formed on the connection portion side of the press-fit portion, the shoulder portion having a reinforcement portion with different cross-sectional areas along the length of the reinforcement portion.

2. A press-fit terminal according to claim 1, wherein the shoulder portion has a shoulder portion end adjacent to the connection portion side of the press-fit portion, the shoulder portion end being formed to be large enough to be pressed by a jig.

3. A press-fit terminal according to claim 2, wherein a part of the shoulder portion that is closest to the press-fit portion is narrower than the shoulder portion end.

4. A press-fit terminal according to claim 1, wherein the shoulder portion has the reinforcement portion formed along an axis line direction of the wire material.

5. A press-fit terminal according to claim 1, wherein the reinforcement portion is extended in a convex pattern along an axis line direction of the wire material.

6. A press-fit terminal according to claim 1, wherein the shoulder portion has the reinforcement portion that extends, from an end of a portion protruding in a lateral direction of the wire material, in a direction that is at right angles with the lateral direction.

7. A press-fit terminal according to claim 4, wherein the wire material further has a linking portion that links the shoulder portion and the press-fit portion, the linking portion being integrally formed with the shoulder portion and the press-fit portion between the shoulder portion and the press-fit portion.

8. A press-fit terminal according to claim 7, wherein the reinforcement portion is formed from the shoulder portion to the linking portion.

9. A press-fit terminal according to claim 1, wherein the shoulder portion and the press-fit portion are each formed so as to protrude symmetrically with respect to an axis line direction of the wire material.

10. A press-fit terminal according to claim 1, wherein the press-fit portion has an elongated hole formed in a central portion thereof;

wherein the press-fit portion has an outer side surface that is formed to have a thickness that is substantially the same as a thickness of the wire material, and wherein the thickness of the outer side surface decreases toward the elongated hole.

11. A press-fit terminal according to claim 1, wherein the tip and the connection portion are each tapered toward an end thereof, and wherein a surface at the end of the tip in section and a surface at the end of the connection portion in section are each a twisted-off section.

12. A connector, comprising:

a housing with a plurality of openings, the housing being formed from an insulating material, and a plurality of press-fit terminals that are fit to each of the plurality of openings, respectively; wherein the plurality of press-fit terminals are made up of a wire material of a given length, each of the plurality of press fit terminals includes:

a tip that is formed on the wire material at one end to be inserted in a substrate;

a connection portion that is formed on the wire material at another end to be connected to an opposite terminal;

a press-fit portion that is formed on the tip side of the wire material to be press-fit to the substrate; and a shoulder portion formed on the connection portion side of the press-fit portion, the shoulder portion having a reinforcement portion with different cross-sectional areas along the length of the reinforcement portion.

13. A press-fit terminal continuous body, comprising a plurality of press-fit terminals which are formed after another continuously in a wire material, wherein each of the plurality of press-fit terminals includes:

a tip that is formed on the wire material at one end to be inserted in a substrate;

a connection portion that is formed on the wire material at another end to be connected to an opposite terminal;

a press-fit portion that is formed on the tip side of the wire material to be press-fit to the substrate; and a shoulder portion formed on the connection portion side of the press-fit portion, the shoulder portion having a reinforcement portion with different cross-sectional areas along the length of the reinforcement portion;

the tip of the one press-fit terminal is coupled to the connection portion of the another press-fit terminal.

14. A wound press-fit terminal continuous body, comprising the press-fit terminal continuous body that is wound into a coil, wherein the press-fit terminal continuous body includes a plurality of press-fit terminals that are formed after another continuously in a wire material;

each of the plurality of press-fit terminals includes:

a tip that is formed on the wire material at one end to be inserted in a substrate;

a connection portion that is formed on the wire material at another end to be connected to an opposite terminal;

a press-fit portion that is formed on the tip side of the wire material to be press-fit to the substrate; and a shoulder portion formed on the connection portion side of the press-fit portion, the shoulder portion having a reinforcement portion with different cross-sectional areas along the length of the reinforcement portion;

the tip of the one press-fit terminal is coupled to the connection portion of the another press-fit terminal.

15. A press-fit terminal according to claim 4, wherein the shoulder portion has another reinforcement portion that extends, from an end of a portion protruding in a lateral direction of the wire material, in a direction that is at right angles with the lateral direction.

* * * * *